United States Patent [19]

Chestnut

[11] 4,400,685

[45] Aug. 23, 1983

[54] CONTROL SYSTEM

[75] Inventor: Benjamin F. Chestnut, Indianapolis, Ind.

[73] Assignee: Emhart Industries, Inc., Indianapolis, Ind.

[21] Appl. No.: 303,878

[22] Filed: Sep. 21, 1981

[51] Int. Cl.[3] ..... H01C 10/36

[52] U.S. Cl. ..... 338/172; 338/167; 338/170; 338/174; 338/198; 338/200

[58] Field of Search ..... 338/163, 170, 171, 172, 338/174, 167, 188, 160, 162, 198, 200; 200/11 T, 11 TW

[56] References Cited

U.S. PATENT DOCUMENTS

| | | | |
|---|---|---|---|
| 506,092 | 10/1893 | Billberg | 338/170 X |
| 1,574,521 | 2/1926 | Stern et al. | 338/170 X |
| 2,632,830 | 3/1953 | Aust et al. | 338/171 |
| 2,784,283 | 3/1957 | Mucher | 338/171 |
| 2,798,137 | 7/1957 | Rasmussen | 338/171 X |
| 2,855,490 | 10/1958 | Arisman et al. | 338/172 |
| 3,072,872 | 1/1963 | O'Shea | 338/174 |
| 3,312,925 | 4/1967 | Frantz | 338/172 X |
| 3,349,358 | 10/1967 | Cassedy, Jr. | 338/172 |
| 3,375,446 | 3/1968 | Guyton | 338/172 X |
| 3,588,778 | 6/1971 | Edwards, Jr. et al. | 338/198 X |

FOREIGN PATENT DOCUMENTS

| | | | |
|---|---|---|---|
| 238652 | 7/1969 | U.S.S.R. | 338/167 |

*Primary Examiner*—C. L. Albritton

*Attorney, Agent, or Firm*—Robert F. Meyer; David W. Gomes

[57] ABSTRACT

An electrical contact arm is spring biased against electrical paths by a coil spring which is carried on a hub of a rotating member which also carries the electrical arm. An electrically conductive path is also carried by the rotating member to provide switching functions.

6 Claims, 4 Drawing Figures

CONTROL SYSTEM

BACKGROUND OF THE INVENTION

Generally speaking, the present invention pertains to a control system which provides a variable resistor and in general comprises a housing, a resistance path and a collector path carried in the housing, a rotating member carried in the housing, an electrical contact arm carried by the rotating member, spring means carried by the rotating member and engaging the electrical contact arm to bias same against the resistance and collector paths, and a set of electrical terminals carried by the housing and electrically connected to the resistance and collector paths.

The control system of the present invention also contemplates a switch which in general comprises a second set of electrical terminals carried by the housing, an electrical contact means carried by the rotating member and selectively bridging the second set of electrical terminals.

The present invention pertains to a control system which includes a combination of a variable resistor and a switch which is particularly adaptable for use in automobiles. More particularly, the variable resistor of the control system can be used to provide a variable resistance output to control the light intensity of the automobile's instrument panel and, at the same time, provide a switching function to turn the dome light on and off for example.

FEATURES OR OBJECTS OF THE INVENTION

It is, therefore, a feature of the present invention to provide a control system which includes a combination variable resistor and switch. Another feature of the invention is to provide such a control system which includes a rotating member and an electrical contact arm carried by the rotating member and electrically bridging a resistance path and collector path as the rotating member rotates. Still another feature of the invention is the provision of such a control system wherein the electrical contact arm is biased against the resistance and collector paths by spring means carried by the rotating member. Yet another feature of the invention is to provide such a control system wherein the contact arm includes a pair of fingers each of which is biased against their respective resistance path or collector path through a pair of coil springs carried by the rotating member. Another feature is the provision of a spring member which electrically connects electrical paths to other electrical elements such as electrical terminals. Another feature of the invention is to provide a control system which further includes an electrical contact means carried by the rotating member to selectively bridge a set of electrical terminals to provide the switching function.

DETAILED DESCRIPTION OF THE INVENTION

Figure 1:
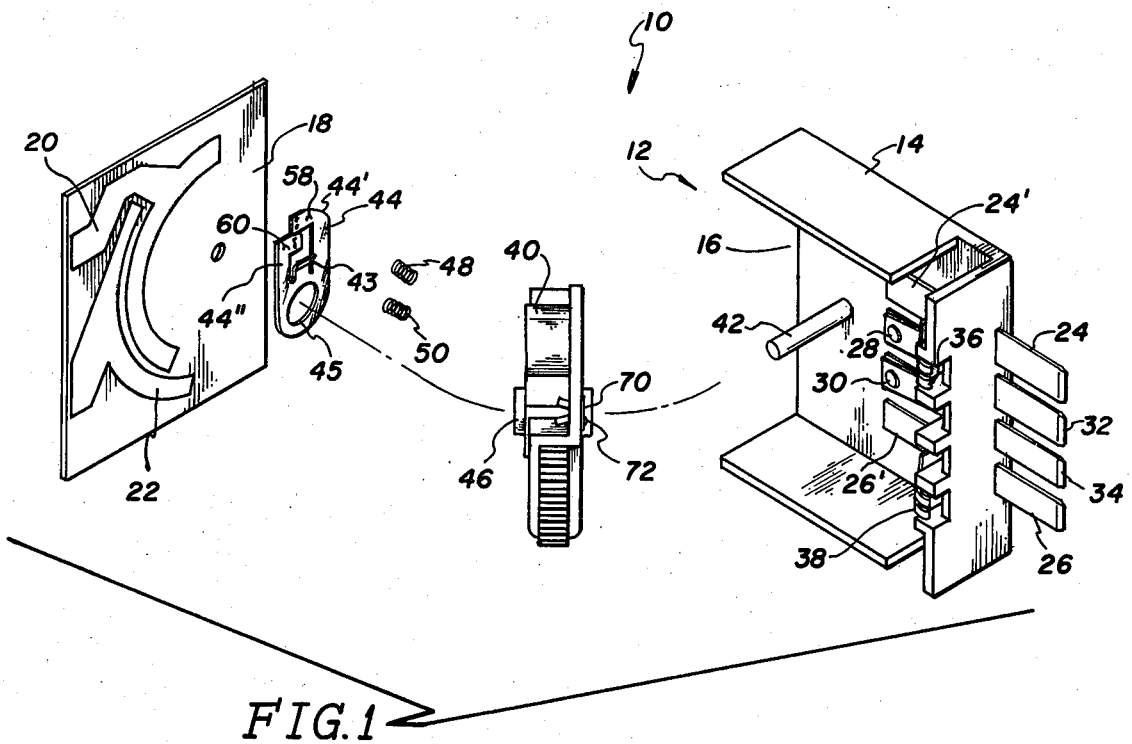
FIG. 1 is an exploded view of a control system employing the features of the invention.

Referring now to the drawings, there is shown a control system 10 which includes a housing 12 formed from a three sided cup-shaped member 14 which is closed by a cover or base member 18. A resistance path 20 and a collector path 22 are carried on the base member 18. A suitable material for the base member 18 could be an electrically insulated plastic material and for the resistance path and collector path, a carbon based material could be used. Alternatively, base member 18 may be a porcelain enamel metal strip such as porcelain enamel steel and paths 20 and 22 could be carbon or a silver based palladium alloy.

The present control system is a combination variable resistor and switch. To that end, a pair of electrical terminals 24 and 26 are connected to the resistance path 20 and collector path 22 through the ends 24' and 26' in a manner to be described. The switching function is provided through electrical contacts 28 and 30 which are carried on the combination contact blades and electrical terminals 32 and 34.

Figure 3:
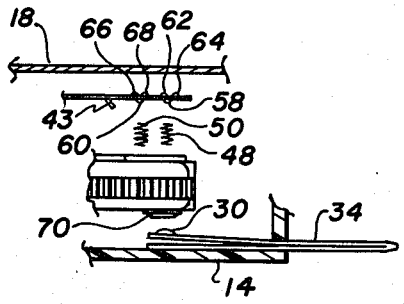
FIG. 3 is an exploded view showing the relationship between a contact arm and a rotating member which carries the contact arm.
Figure 4:
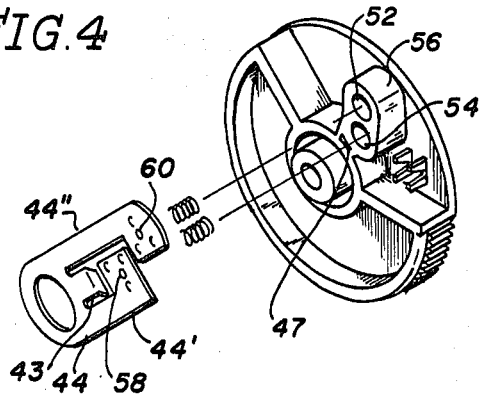
FIG. 4 is another exploded view showing the relationship between the contact arm and the rotating member.

A rotating member 40 such as a dial is rotatably carried on post 42 with the member extending out opening 16 for manual operation. An electrical contact arm 44 is carried on a hub 46 through aperture 45 for rotation with the rotating member 40. A tang 43 engages a slot 47 (FIG. 4) to insure rotation of the contact arm with the rotating member. A feature of the present invention is the manner in which the contact arm 44 is biased against the resistance and collector paths. More particularly, referring to FIGS. 1, 3 and 4, each of the fingers 44' and 44'' are biased against their respective paths through a pair of coil springs 48 and 50 which are carried in cavities 52 and 54 provided in island 56 of the rotating member 40 and which are held against their respective contact arms with the aid of dimples 58 and 60. Contact arm 44' engages resistance path 20 through dimples 62 and 64 while contact arm 44'' engages collector path 22 through dimples 66 and 68.

The switching function is provided by a switch arm 70 that is also carried by the rotating member 40 and which engages the contacts 28 and 30 upon rotation of the rotating member to selectively close the switch. A detent means comprising a dimple 72 carried on the switch arm 70 locates the rotating member with respect to contacts 28 and 30.

Figure 2:
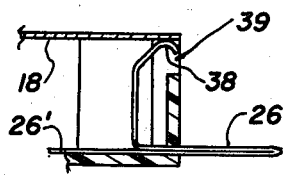
FIG. 2 is a partial cross section showing electrical terminals of the control system.

Another feature of the invention is the manner in which electrical connections are made between the resistance and collector paths 20 and 22 and electric terminals 24 and 26. More specifically, as shown in FIGS. 1 and 2, the electrical connections are made through spring members 36 and 38 which are wedged or otherwise trapped against the paths within slots 39 to insure a good positive electrical connection. This arrangement is especially useful when base member 18 is a porcelain enamel metal where a mechanical connection such as a rivit would be very difficult to achieve. The spring member may be either constructed integrally with the electrical terminals or as a separate member.

In operation, manual rotation of rotating member 40 causes rotation of contact arm 44 by virtue of the engagement of tang 43 with slot 47. Coil springs 48 and 50 maintain engagement of fingers 44' and 44'' with resistance path 20 and collector path 22 to provide a variable resistance output through terminals 24 and 26. Rotation of rotating member 40 also causes selective engagement of switch arm 70 with contacts 28 and 30 such that when the arm bridges the contacts a closed electrical circuit is provided through terminals 32 and 34.

What is claimed is:

1. A combination of a switch and variable resistor comprising:

(a) a housing, (b) at least four electrical terminals carried by said housing, (c) a resistance path and a collector path carried by said housing and individually electrically connected to two of said four electrical terminals, (d) a rotating member rotatably carried in said housing, (e) an electrical contact arm carried by said rotating member, (f) spring means carried by said rotating member and engaging said electrical contact arm to bias same against said resistance and collector paths, and (g) an electrically conductive path carried by said rotating member selectively engaging another two terminals of said four terminals to provide said switch.

2. Combination according to claim 1 wherein said electrical contact arm includes a pair of fingers, one engaging said resistance path, the other said collector path, said spring means including separate springs one for each of said pair of fingers.

3. Combination according to claim 2 wherein said separate springs are coil springs.

4. Combination according to claim 3 further including an island carried by said rotating member and holes in said island receiving said coil springs.

5. Combination according to claim 1 wherein said resistance and collector paths are electrically connected to said electrical terminals by spring means carried by said electrical terminal and engaging said resistance and collector paths.

6. The combination according to claim 1 further including detent means carried by said electrically conductive path to locate same with respect to said another two terminals.

* * * * *